United States Patent [19]

Holloway, Jr.

[11] Patent Number: 4,729,281

[45] Date of Patent: Mar. 8, 1988

[54] EXTENSION HANDLE APPARATUS FOR USE WITH A CONVENTIONAL WRENCH

[76] Inventor: Walter M. Holloway, Jr., 5013 Maid Marion Dr., Pascagoula, Miss. 39567

[21] Appl. No.: 875,548

[22] Filed: Aug. 7, 1986

Related U.S. Application Data

[63] Continuation of Ser. No. 764,729, Aug. 12, 1985, abandoned.

[51] Int. Cl.[4] ..... B25G 1/04

[52] U.S. Cl. ..... 81/177.2; 81/177.85

[58] Field of Search ..... 81/177.2, 489, 177.85, 81/491; 403/108, 109

[56] References Cited

U.S. PATENT DOCUMENTS

| | | | |
|---|---|---|---|
| 483,461 | 9/1892 | Litel | 81/177.2 |
| 1,638,252 | 8/1927 | Fitzgerald | 81/177.2 |
| 2,621,688 | 12/1952 | Wales | 81/177.2 |
| 2,846,910 | 8/1958 | Brown | 81/64 |
| 3,351,111 | 11/1967 | Biddle | 81/177.2 |
| 4,398,314 | 8/1983 | Converse | 7/151 |

*Primary Examiner*—Frederick R. Schmidt
*Assistant Examiner*—Bradley I. Vaught
*Attorney, Agent, or Firm*—Donald A. Kettlestrings

[57] ABSTRACT

An extension handle apparatus, for use with a conventional wrench having a handle and an opening defined within and adjacent a free end of the handle, the extension handle apparatus including a tubular sleeve member defining an open port at one end thereof and an open interior space for receiving the wrench handle. A plurality of aligned, square bolt-receiving openings are provided within two opposed walls of the tubular sleeve member, and locking means extend through predetermined and opposed ones of the bolt-receiving openings in the sleeve member and through the wrench handle opening for locking the sleeve member into safe and secure position on the wrench handle.

8 Claims, 10 Drawing Figures

EXTENSION HANDLE APPARATUS FOR USE WITH A CONVENTIONAL WRENCH

This application is a continuation of application Ser. No. 764,729, now abandoned filed Aug. 12, 1985, for Extension Handle.

This invention relates to extension handle apparatus and more particularly to an extension handle apparatus for use with a conventional wrench wherein the wrench handle is adjustable in length to provide for various amounts of torque as the nature of the work requires.

It is an object of the present invention to provide an extension handle apparatus for use with a conventional wrench.

Another object is to provide such an extension handle apparatus which enables quick and easy adjustment of the length of a conventional wrench handle.

A further object of the invention is the provision of an extension handle apparatus which provides locking means for safely and securely locking the extension handle apparatus at adjustable positions on the wrench handle.

Yet another object of the present invention is the provision of an extension handle apparatus which enables a conventional wrench to gain access to hard to reach work areas.

A still further object of the present invention is to provide an extension handle apparatus for use with a conventional wrench which provides for additional torque as required.

Another object is to provide for an extension handle apparatus which can be safely and securely locked into position onto the handle of a conventional wrench.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides an extension handle apparatus, for use with a conventional wrench having a handle and an opening defined within and adjacent a free end of the handle, the extension handle apparatus comprising: a tubular sleeve member having first and second opposed and substantially parallel wall elements and third and fourth wall elements connecting together the first and second wall elements, the wall elements defining an open port at a first end of the sleeve member and an interior space for receiving the wrench handle; each of the first and second wall elements defining a plurality of aligned bolt-receiving openings therein, each of the bolt-receiving openings in the first wall element in alignment with a respective one of the bolt-receiving openings in the second wall element, and locking means in operative relationship with predetermined ones of the bolt-receiving openings and with the wrench handle opening for enabling the sleeve member to be adjustably locked into position along the length of the wrench handle.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

Figure 1:
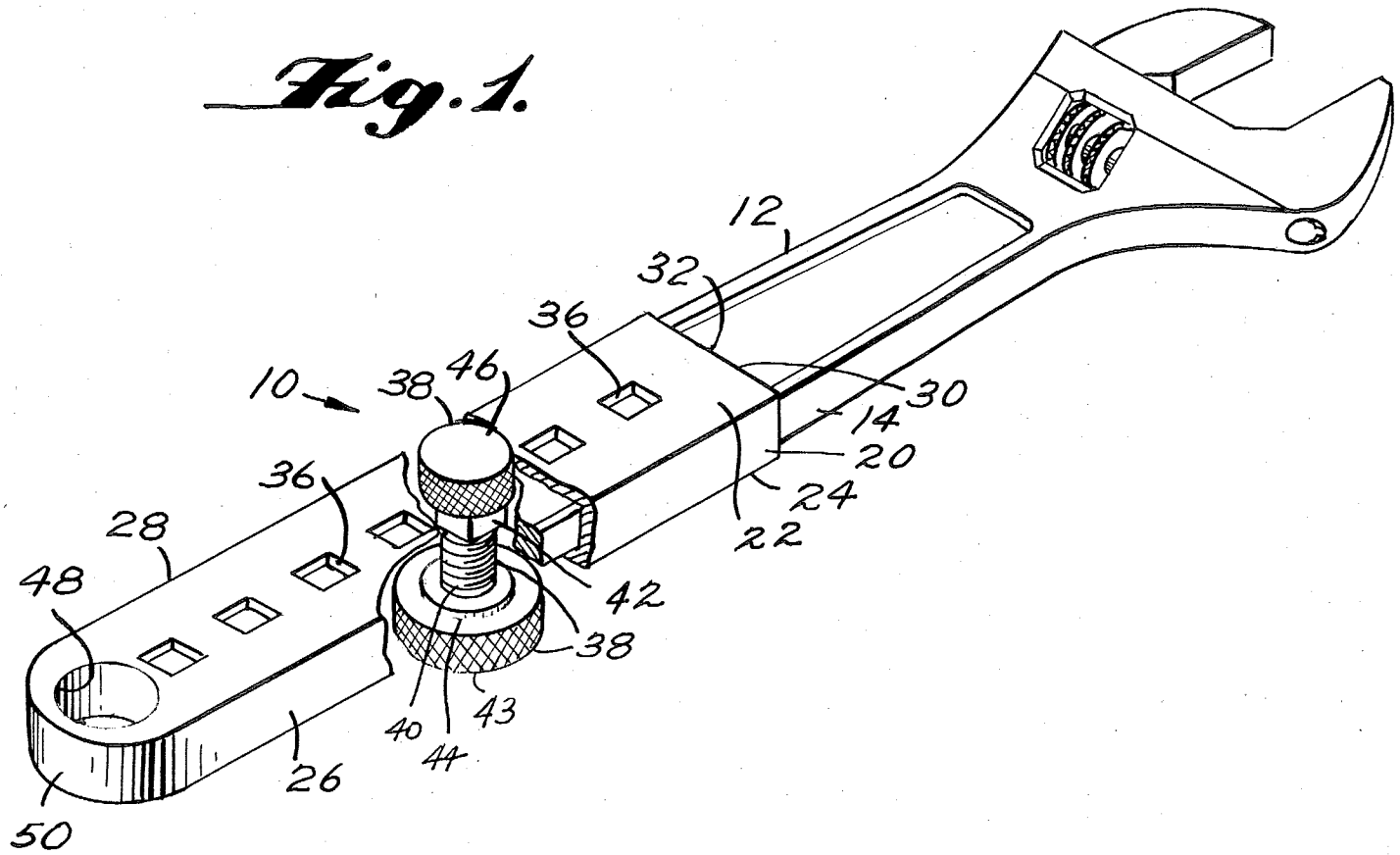
FIG. 1 is a fragmentary perspective view of the invention.
Figure 2:
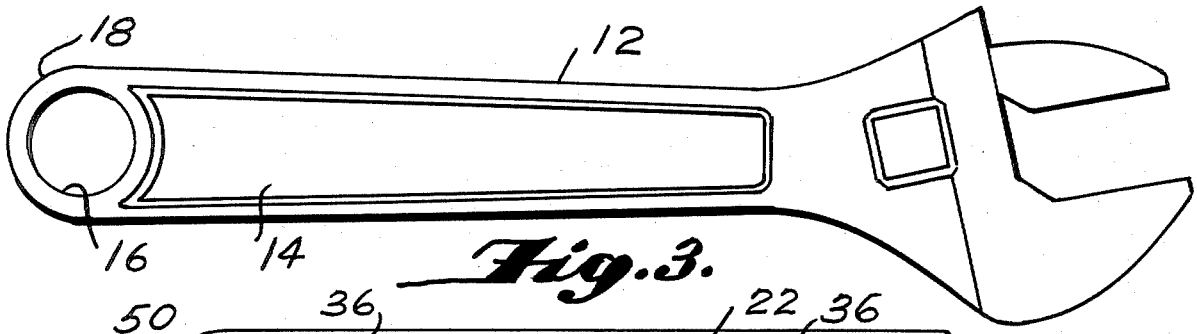
FIG. 2 is a plan view of a conventional wrench which may be used with the extension handle apparaturs of this invention.

With reference now to the drawings, wherein like reference characters designate like or corresponding parts throughout the several views, there is shown extension handle apparatus 10 in accordance with this invention for use with a conventional wrench 12 having a handle 14 and an opening 16 (FIG. 2) defined within the handle and adjacent a free end 18 of handle 14.

Figure 4:
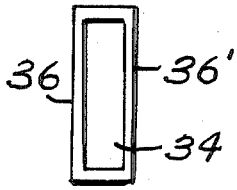
FIG. 4 is an end view of the sleeve member shown in FIG. 3 and looking in the directions of the arrows 4—4 in FIG. 3.
Figure 7:
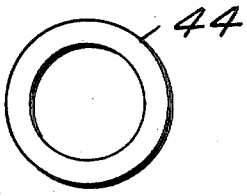
FIG. 7 is a plan view of a washer which forms a part of the locking means in accordance with the invention.
Figure 8:
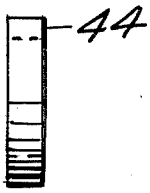
FIG. 8 is a side elevation view of the washer looking in the direction of the arrows 8—8 in FIG. 7.
Figure 5:
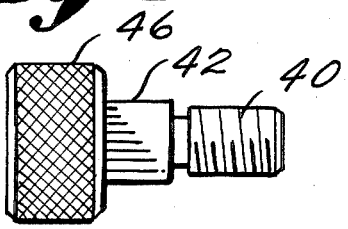
FIG. 5 is a side elevation view of a portion of the locking means.
Figure 6:
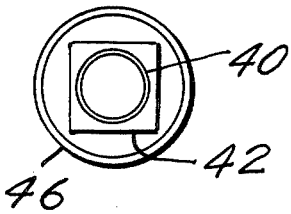
FIG. 6 is an end elevation view of the locking means element shown in FIG. 5 and looking in the direction of the arrows 6—6 in FIG. 5.
Figure 9:
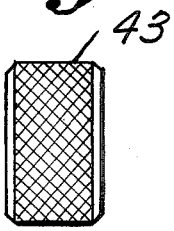
FIG. 9 is a side elevation view of a nut member which forms a part of the locking means of the invention.
Figure 10:
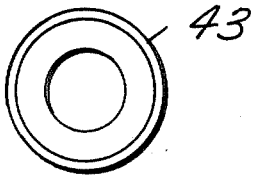
FIG. 10 is an end elevation view of the nut member shown in FIG. 9 and looking in the direction of the arrows 10—10 in FIG. 9.

In accordance with the invention, extension handle apparatus 10 includes a tubular sleeve member 20 having a first wall element 22 and a second opposed wall element 24 substantially parallel to first wall element 22. A third wall element 26 and a fourth wall element 28 connect together first and second wall elements 22, 24, and wall elements 22, 24, 26 and 28 define an open port 30 at a first and 32 of sleeve member 20. The wall members also define an interior space 34 (FIG. 4) of a size and shape for receiving wrench handle 14.

Figure 3:
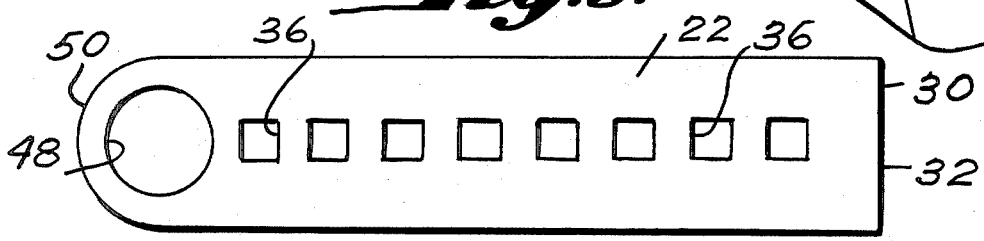
FIG. 3 is a plan view of the tubular sleeve member of the invention.

Each of first and second wall elements 22, 24 defines a plurality of aligned bolt-receiving openings 36, 36', respectively, therein (FIGS. 3 and 4), and each of bolt-receiving openings 36 in first wall element 22 is in alignment with a respective one of bolt-receiving openings 36' in second wall element 24.

In accordance with the invention, locking means 38 are provided in operative relationship with predetermined ones of bolt-receiving openings 36, 36' and with wrench handle opening 16 for enabling sleeve member 20 to be adjustably locked into position along the length of wrench handle 14.

Bolt-receiving openings 36, 36' are preferably square in shape, and locking means 38 preferably include a bolt member 40 defining a shank 42 which is square in cross section and which cross section is sized to slidably fit within each of bolt-receiving openings 36 or 36'. Locking means 38 further include a nut member 43 threaded onto bolt member 40, and bolt member 40 extends through predetermined and opposed ones of bolt-receiving openings 36, 36' in first and second opposed wall elements 22, 24 and through wrench handle opening 16 to lock sleeve member 20 into position on wrench handle 14.

Locking means 38 further include a washer 44 positioned on bolt member 40 and held, for example, between second wall element 24 and nut member 43 by the nut member. Bolt member 40 further includes a knurled head 46 bearing against first wall element 22, and nut member 43 also is preferably knurled to enable easy manual manipulation of the nut member.

In a preferred embodiment of the invention, sleeve member 20 defines a hanger hole 48 adjacent a second end 50 of sleeve member 20, and bolt-receiving openings 36, 36' and interior space 34 preferably extend along substantially the entire length of sleeve member 20 to accomodate substantially the entire length of wrench handle 14.

Extension handle apparatus 10 is preferably comprised of stainless steel.

This invention provides for an extension handle apparatus to be used with a conventional wrench whereby the conventional wrench handle can be easily and quickly extended in length to provide for increased torque. The extension handle apparatus is designed to permit secure locking into position of sleeve member 20 on wrench handle 14 so that no slipping of sleeve member 20 over the wrench handle can occur while the wrench is being used. Locking means 38, in cooperation with bolt-receiving openings 36, 36' and wrench handle opening 16, provide for a safe and secure locking arrangement.

The invention in its broader aspects is not limited to the specific details shown and described, and departures may be made from such details without departing from the principles of the invention and without sacrificing its chief advantages.

What is claimed is:

1. An extension handle apparatus, for use with a conventional wrench having a handle and an opening defined within and adjacent a free end of said handle, said extension handle apparatus comprising:

a tubular sleeve member having first and second opposed and substantially parallel wall elements and third and fourth wall elements connecting together said first and second wall elements, said wall elements defining an open port at a first end of said sleeve member and an interior space for receiving said wrench handle;

each of said first and second wall elements defining a plurality of aligned bolt-receiving openings therein, each of said bolt-receiving openings in said first wall element in alignment with a respective one of said bolt-receiving openings in said second wall element; and locking means extending through predetermined and opposed one of said bolt receiving openings in said first and second opposed wall elements and through said wrench handle opening.

2. Apparatus as in claim 1 wherein said bolt-receiving openings are square.

3. Apparatus as in claim 2 wherein said locking means include:

a bolt member defining a shank which is square in cross section and which cross section is sized to slidably fit within each of said bolt-receiving openings: and a nut member threaded onto said bolt member:

said bolt member extending through predetermined and opposed ones of said bolt-receiving openings in said first and second opposed wall elements and through said wrench handle opening.

4. Apparatus as in claim 3 wherein said locking means further include a washer positioned on said bolt member and held between said second wall element and said nut member by said nut member.

5. Apparatus as in claim 4 wherein said bolt member further includes a knurled head bearing against said first wall element and wherein said nut member is knurled to enable easy manual manipulation of said nut member.

6. Apparatus as in claim 5 wherein said sleeve member further defines a hanger hole adjacent a second end thereof.

7. Apparatus as in claim 6 wherein said plurality of bolt-receiving openings and said interior space extend along substantially the entire length of said sleeve member.

8. Apparatus as in claim 7 wherein said sleeve member is comprised of stainless steel.

* * * * *